US008733275B2

(12) United States Patent
Nishimori et al.

(10) Patent No.: US 8,733,275 B2
(45) Date of Patent: May 27, 2014

(54) APPLICATION APPARATUS, APPLICATION METHOD AND METHOD FOR MANUFACTURING WEB HAVING COATING FILM

(75) Inventors: Yutaka Nishimori, Kyoto (JP); Hiroyuki Inoue, Otsu (JP); Masaharu Tooyama, Otsu (JP)

(73) Assignee: Toray Industries, Inc., Tokyo (JP)

( * ) Notice: Subject to any disclaimer, the term of this patent is extended or adjusted under 35 U.S.C. 154(b) by 1678 days.

(21) Appl. No.: 11/908,198

(22) PCT Filed: Mar. 6, 2006

(86) PCT No.: PCT/JP2006/304237
§ 371 (c)(1),
(2), (4) Date: Sep. 10, 2007

(87) PCT Pub. No.: WO2006/095669
PCT Pub. Date: Sep. 14, 2006

(65) Prior Publication Data

US 2009/0079105 A1 Mar. 26, 2009

(30) Foreign Application Priority Data

Mar. 11, 2005 (JP) ..... 2005-068947

(51) Int. Cl.
*B05B 3/00* (2006.01)
*B05D 3/12* (2006.01)

(52) U.S. Cl.
USPC ..... 118/323; 427/359

(58) Field of Classification Search
USPC ..... 118/323
See application file for complete search history.

(56) References Cited

U.S. PATENT DOCUMENTS

| | | | | |
|---|---|---|---|---|
| 5,243,841 | A * | 9/1993 | Fleissner | 68/205 R |
| 5,737,945 | A * | 4/1998 | Fleissner | 68/200 |
| 6,364,547 | B1 * | 4/2002 | Matsuyama et al. | 396/611 |

FOREIGN PATENT DOCUMENTS

| | | | |
|---|---|---|---|
| JP | 51-089543 | A | 8/1976 |
| JP | 56-129862 | | 10/1981 |
| JP | 05-329418 | A | 12/1993 |
| JP | 2805177 | B | 7/1998 |
| JP | 11-216412 | A | 8/1999 |
| JP | 2000-042470 | A | 2/2000 |
| JP | 2001-179153 | A | 7/2001 |

(Continued)

OTHER PUBLICATIONS

"Theory and Explanation of Die Coater; Coating—Learning for Future from Equipment Technology in the Past and Present", Yoshinobu Katagirl, Japan, Converting Technical Institute Co., Ltd. Mar. 25, 2002, p. 399.

(Continued)

*Primary Examiner* — Dah-Wei Yuan
*Assistant Examiner* — Charles Capozzi
(74) *Attorney, Agent, or Firm* — RatnerPrestia

(57) ABSTRACT

The application of a coating liquid, wherein a coating liquid being supplied is applied on the upper surface of a running web by the use of an application bar, to thereby form a coating film having a desired thickness, characterized in that in the upstream side from the application bar, the coating liquid is directly supplied to a standing liquid being formed in contact with both of the application bar and the web, or the coating liquid is allowed to flow down on a smooth surface in a such a state that its upper side is open to the outside and is supplied for the web.

7 Claims, 10 Drawing Sheets

(56) References Cited

FOREIGN PATENT DOCUMENTS

| | | | | |
|---|---|---|---|---|
| JP | 2001-196300 | A | 7/2001 | |
| JP | 2001179153 | A * | 7/2001 | ..... B05C 1/14 |
| JP | 2003-093947 | | 4/2003 | |

OTHER PUBLICATIONS

International Search Report dated Apr. 4, 2006, application No. PCT/JP2006/304237, dated Apr. 4, 2006.

* cited by examiner

APPLICATION APPARATUS, APPLICATION METHOD AND METHOD FOR MANUFACTURING WEB HAVING COATING FILM

TECHNICAL FIELD

The present invention relates to an application apparatus and an application method in which a coating liquid is applied over the upper face of a traveling web, such as film, by using an application bar. The present invention also relates to a method of using the application apparatus or the application method to produce a web having a coating film. The invention provides an application apparatus and an application method that can prevent defects arising from inappropriate coating on a web, such as formation of feeding streaks or bubble streaks on a face of the web supplied with a coating liquid and uneven thickness distributions of the coating liquid.

BACKGROUND ART

For example, FIG. 7 shows a known application apparatus comprising a die 102, which serves as a coating liquid supplying means, to supply a coating liquid 103 onto the upper face of a traveling web 101, and a freely rotatable metering bar 105, which serves as an application bar, provided downstream from the die 102 and supported by four rollers 104 (a pair at each side, i.e., each end in the width direction, totaling four) to meter or smooth the coating thickness of the coating liquid supplied onto the upper face of the web 101.

With such a conventional apparatus, however, feeding streaks 106 of the coating liquid or bubble streaks 107 taking in air from outside can be formed as shown in FIG. 8. Such feeding streaks 106 or bubble streaks 107 are generally regarded as coating defects. These coating defects are considered to result from uneven supply of the coating liquid 103 from the die 102, or result, as shown in FIG. 9, from air getting between the coating liquid 103 and the web 101 at the position indicated by the arrow A between the coating liquid 103 supplied and the web 101 if air is not removed properly by the metering bar 105.

With the aim of eliminating the defects, Patent Document 1 has disclosed an application method that assumes use of a relatively low-viscosity coating liquid. In the application method, a coating liquid is applied over a face of a web by supplying the coating liquid onto an application bar from a die provided near the application bar to form a bead at a contact portion of the application bar and the web.

In response to a request to develop a technique for applying a high-viscosity coating liquid having a viscosity of not less than 0.1 Pa·s (100 cp), the present inventors attempted use of an application method as described in Patent Document 1. It was found, however, that the application method cannot prevent formation of feeding streaks in a coating applied over a face of a web.

It has been also found that when using a high-viscosity coating liquid having a viscosity not less than 0.1 Pa·s (100 cp), furthermore, air is taken in between a coating liquid 103 and an application bar 105 at position indicated by the arrow B between the coating liquid 103 supplied onto the application bar 105 and application bar 105 as shown in FIG. 10, and the coating liquid 103 containing air flows into a bead 100, resulting in bubbles being caught under the application bar 105 to form bubble streaks in a coating film on a web.

Moreover, if uneven supply in a web's width direction takes place when supplying the coating liquid from a die or nozzle, such unevenness would not be eliminated completely by the application bar, resulting in an uneven thickness distribution of the coating liquid applied. To preventing this, the slit gap of the die may be decreased as a means of feeding the coating liquid uniformly in the web's width direction. But, cleaning of the lip portion would be difficult to perform if the slip gap is small. If a width of the die (the width is in the width direction of the web) is large and a coating liquid feeding pressure is high, the lip gap would be increased by a high internal pressure, making it impossible to maintaining a uniform gap in the width direction.

By the way, a slide coater that appears to be similar to a preferred embodiment of the invention is disclosed in Non-Patent Document 1.

Patent Document 1: JP 2805177 B

Non-Patent Document 1: "Theory and Explanation of Die Coater; Coating—Learning for Future from Equipment Technology in the Past and Present—", Yoshinobu Katagiri, Japan, Converting Technical Institute Co., Ltd., Mar. 25, 2002, p. 399

DISCLOSURE OF THE INVENTION

Problems to be Solved by the Invention

The object of the invention is to solve the above-mentioned problems to prevent feeding streaks likely to form during a coating liquid supply process and bubble streaks that form after taking in air and to provide an application apparatus and an application method that can prevent uneven thickness distribution resulting from uneven supply of the coating liquid.

Means for Solving the Problem

An application apparatus of the invention for achieving the above-mentioned objects is as follows:

An application apparatus for applying a coating liquid on an upper surface of a running web by the use of an application bar, in which a coating liquid supplying means is provided to supply the coating liquid directly to a bead forming area in the upstream neighborhood of a contact portion between the application bar and the web. Hereafter, this application apparatus is referred to as the first-type application apparatus.

In the invention, the term "bead" refers to a liquid pool of the coating liquid that is formed during a coating process, at an area from a contact portion of the application bar and the web to the upstream side of the web. It is needless to say that a thin layer of the coating liquid remaining on a surface of the application bar or on a surface of the web is not the bead defined above. The thin layer of the coating liquid moves along with moving of the application bar or moving of the surface of the web, and it does not constitute a state of pool.

An area in the upstream neighborhood of the application bar where such a bead is to be formed is hereafter referred to as a bead forming area.

In the invention, the term "supplying a coating liquid directly into the bead forming area" means supplying a coating liquid, which is discharged from a coating liquid supplying means such as nozzle and die, into the bead forming area, thus adding the coating liquid directly to the bead before the coating liquid comes in contact with the web or the application bar.

In the invention, the term "application bar" refers to a bar as conventionally used for applying a coating liquid, such as a rod, a wire bar comprising a rod wound with a wire, or a grooved bar produced by grooving a rod. The application bar normally can rotate in the same direction as a running direction of the web, but it may rotate in the opposite direction to the running direction of the web.

Another application apparatus of the invention for achieving the above-mentioned objects is as follows:

An application apparatus for applying a coating liquid on an upper surface of a running web by the use of an application bar, in which a coating liquid supplying means is provided to supply the coating liquid to the upper surface of the web at a position upstream from a position of the application bar, wherein the coating liquid supplying means has a smooth portion on which the coating liquid flows down in a state that the upper side of the coating liquid is open to the outside. Hereafter, this application apparatus is referred to as the second-type application apparatus.

In the invention, the term "state that the upper side of the coating liquid is open to the outside" refers to a state where the vertically upper face of the coating liquid is in contact with a gas alone as the coating liquid flows down on a surface of an object.

In the invention, the term "smooth portion" refers to a surface portion of the coating liquid supplying means that forms the bottom face of a flowing passage in which the coating liquid flows in a state that the upper side of the coating liquid is open to the outside during supplying of the coating liquid. The surface roughness (maximum height Ry) and the flatness of the smooth portion is not more than 100μ and not more than 0.2 mm, respectively.

The surface roughness is measured according to JIS B0633 by performing observation from the direction of the arrow X with the angle α adjusted to 90° in FIG. 11, that is, from the perpendicular direction to the smooth portion, using a super focal depth profilometer (VK8500 manufactured by Keyence Corporation).

The flatness is measured according to JIS B0621 by performing observation from the direction of the arrow X in FIG. 11, as in the case of surface roughness measurement, using a high-accuracy three-dimensional profile measurement system (XYZAXGC600D-34 manufactured by Tokyo Seimitsu Co., Ltd.).

In the second-type application apparatus, it is preferable that an inclination angle of the smooth portion to the horizontal direction is in the range of 10 to 60° and a distance along which the coating liquid flows down with its upper face open to the outside is in the range of 10 to 200 mm.

In the invention, the term "inclination angle of the smooth portion to the horizontal direction" refers to the angle formed between the horizon and the surface of the smooth portion which is indicated as inclination angle θ in FIG. 11. If the inclination angle θ is less than 10°, the coating liquid would spill down from either end of the smooth portion onto the web as it flows down, possibly causing feeding streaks. If the inclination angle θ is more than 60°, on the other hand, the coating liquid would not become flat enough as it flows on the smooth portion.

In the second-type application apparatus, it is preferable that the coating liquid supplying means is provided at a position that allows the coating liquid to be supplied directly to a bead forming area existing in the upstream neighborhood of the contact portion of the application bar and the web.

In the second-type application apparatus, the edge of the smooth portion that is faced toward the application bar has an arc-like recessed shape having both end portions thereof being extended farther downward than the center portion thereof in the width direction of the web.

A contour of an external face of the bead formed at the upstream side of the application bar tends to bulge at the center portion in the width direction of the web, with the bulge becoming smaller at both end portions. Such a bulge is shown in FIG. 12B.

An embodiment of the application apparatus of the invention is shown in FIGS. 12A and 12B. In FIGS. 12A and 12B, a die 110 which serves as coating liquid supplying means, has a smooth portion 111 at the tip thereof. A portion of the tip of the smooth portion 111 is in contact with a bead 108. In such state, a coating liquid is supplied to the bead 108, and then the coating liquid is metered and/or smoothed by, for example, a metering bar 105 supported downstream with four rollers 104, two at either end, which serves as application bar, as the coating liquid is applied with a desired thickness on the upper surface of the web 101, which is running in the direction indicated by the arrow 12X.

A contour of the external face of the bead 108 tends to bulge at its center in the width direction of the web, with the bulge becoming smaller at both end portions, as shown in FIG. 12B. When the coating liquid is supplied with the tip of the smooth portion 111 kept in contact with the bead 108, streaks 109 can be produced at positions that correspond to either end 113 of the smooth portion 111 that is in contact with the bead 108. In such a case, a usable width for producing a product from the coated web becomes narrow.

This problem will be solved with an embodiment of the application apparatus 11 as shown in FIGS. 13A and 13B. In the embodiment show in FIGS. 13A and 13B, a form of a tip 111*e* of a smooth portion 111*a* is almost fitted to an external form of a bead 108*a*, in particular just fitted at both end portions of the bead 108*a*, to allow the tip of the smooth portion 111*a* to be in contact with the bead 108*a* over nearly the entire width as shown in FIG. 13B. In this embodiment, the position of streaks 109*a* shift toward the end of the coated portion, and this serves to widen the coated portion of the web that can be used as product.

In the invention, the term "arc-like recessed shape" refers to a shape such that the tip of the smooth portion is recessed at its center in the width direction of the web whereas it extends downward at both ends. This shape should preferably fit the shape of the external face of the bead 108*a*, but may not be in the shape of a circular arc, and may be a shape formed by two or more straight lines that are connected continuously.

In the first-type application apparatus and the second-type application apparatus, it is preferable that the coating liquid supplying means comprises a means of supplying the coating liquid continuously. Specifically, it is preferable that the coating liquid is supplied from the coating liquid supplying means continuously without severance. As stated later, intermittent supply of the coating liquid to the bead will be likely to cause feeding streaks.

In the first-type application apparatus and the second-type application apparatus, it is preferable that the coating liquid supplying means comprise a means for adjusting a distance over which the coating liquid supplied from the coating liquid supplying means falls down to the bead to at not more than 80 mm. If the coating liquid having left the coating liquid supplying means falls down toward the bead over a large distance before reaching the bead, the state of the bead would become unstable as a result of pressure fluctuations that occur in the coating liquid as it falls down. If the state of the bead becomes unstable, it will be more likely to cause coating defects.

In the invention, the term "distance over which the coating liquid falls down to the bead" refers to the vertical distance over which the coating liquid, after leaving the coating liquid supplying means, moves in a gas before coming in contact with the bead.

The distance will be explained with reference to FIGS. 1 and 11. FIG. 1 shows a schematic side view of the first-type application apparatus while FIG. 11 shows a schematic side view of the second-type application apparatus. In an application apparatus 10 shown in FIG. 1, a coating liquid 4 is discharged from a die 3, which serves as coating liquid supplying means, and supplied directly to a bead 6, and then the coating liquid in the bead 6 is applied by an application bar 1 on the upper surface of a running web 2. In an application apparatus 11 shown in FIG. 11, a coating liquid supplying means comprises a die 3*a* and a smooth portion 20 connected to its edge, and a coating liquid 4*a*, after being discharged from the die 3*a* and flowing down on the upper surface of the smooth portion 20, is directly supplied to a bead 6*a*. The coating liquid in the bead 6*a* is then applied by an application bar 1*a* on the upper surface of a running web 2*a*.

Thus, the term "distance over which the coating liquid falls down to the bead" refers to the vertical distance H from the lower end of the die 3 to the upper end of the bead 6 in FIG. 1, or it refers to the vertical distance Ha from the lower end of the smooth portion 20 to the upper end of the bead 6*a* in FIG. 11.

FIG. 17 shows a schematic side view the second-type application apparatus in another type. In an application apparatus 11*b*, a coating liquid supplying means comprises a die 110*b* and a smooth portion 111*c* connected to its edge, and a coating liquid 4*b*, after being discharged from the die 110*b* and flowing down on the upper surface of the smooth portion 111*c*, is directly supplied to a bead 108*b*, and then the coating liquid in the bead 108*b* is applied by a freely rotatable application bar (metering bar) 105*b*, which is supported by rollers 104*b*, on the upper surface of a traveling web 101*b*. In the application apparatus 11*b*, the end of the smooth portion 111*c* of the coating liquid supplying means is inserted into the bead 108*b*. For an embodiment where the edge of the coating liquid supplying means is inserted into the bead 108*b* as in the case of the application apparatus 11*b*, the term "distance over which the coating liquid falls down to the bead" is defined as zero.

In the first-type application apparatus and the second-type application apparatus, it is preferable that the coating liquid supplying means has a moving means for moving the coating liquid supplying means independently of the application bar. If the coating liquid supplying means can move independently of the application bar, the position of the coating liquid supplying means relative to the application bar can be adjusted properly, making it possible to control the trembling of the coating liquid in cases where, for example, such trembling is caused during the supply process by the static electricity on the web. It also serves to allow the coating liquid supplying means to retreat to the proper position after the completion of the application process.

In this application apparatus, it is preferable that the coating liquid supplying means is able to move over a distance from 0.1 to 500 mm relative to the application bar during the coating liquid application process. Here, the distance from the coating liquid supplying means to the application bar is defined as the minimum distance from the face of the application bar to the coating liquid supplying means. Such distance is shown as the distance L in FIG. 1 and the distance La in FIG. 11. In cases where the smooth portion has an arc-like recessed shape with its end portion extended farther downward than the portion at the center in the width direction of the web, the distance is defined as the minimum distance measured from any position of the smooth portion in the width direction of the web to the face of the application bar.

If the coating liquid supplying means can move over such a range, the position of the coating liquid supplying means relative to the application bar can be adjusted easily, and the coating liquid supplying means can be retreated easily after the completion of the application process.

In the first-type application apparatus and the second-type application apparatus, it is preferable that a liquid receiver is provided to collect the coating liquid from the coating liquid supplying means. Such a receiver can serve to easily prevent the coating liquid from spilling from the coating liquid supplying means onto the web, particularly before the start or after the completion of the application process.

An application method of the invention that can meet the objects is as follows:

An application method, which comprises coating an upper surface of a running web with a coating liquid having a viscosity of 0.1 to 3.0 Pa·s (100 to 3000 cp) by the use of an application bar, wherein the coating liquid is supplied directly to a bead which is formed at the upstream side of a contact portion between the application bar and the web by a coating liquid supplying means. This application method is characterized in that the coating liquid supplied from the coating liquid supplying means first comes in contact with the bead and subsequently comes in contact with the application bar and the web after leaving the bead. This feature is represented by the expression "supplying the coating liquid directly to the bead". This application method is hereafter referred to as the first-type application method.

In the invention, the viscosity is measured according to JIS Z8803 using a rheometer (RC20 manufactured by Rheotech Co., Ltd.).

In the invention, the term "supplying the coating liquid directly to the bead" refers to a process in which the coating liquid discharged from the coating liquid supplying means such as, for example, a nozzle or a die directly comes in contact with the bead before coming in contact with the web or the application bar.

Another application method of the invention that meet the objects is as follows:

An application method which comprises coating an upper surface of a running web with a coating liquid having a viscosity of 0.1 to 3.0 Pa·s by the use of an application bar, wherein the coating liquid is supplied to the upper surface of the web at a position upstream from a position of the application bar by a coating liquid supplying means which has a smooth portion on which the coating liquid flows down in a state that the upper side of the coating liquid is open to the outside. This application method is hereafter referred to as the second-type application method.

In the second-type application method, it is preferable that the inclination angle of the smooth portion to the horizontal direction is in the range of 10 to 60°, and at the same time that the distance over which the coating liquid flows down with its upper face open to the outside is in the range of 10 to 200 mm.

In the second-type application method, it is preferable that the coating liquid is supplied by the coating liquid supplying means directly to the bead that forms at the contact portion of the application bar and the web.

In the second-type application method, it is preferable that the edge of the smooth portion has an arc-like recessed shape with its end portions extended farther downward than the portion at the center in the width direction of the web, in order to fit the shape of the bead.

In the first-type application method and the second-type application method, it is preferable that the coating liquid supplying means is able to supply the coating liquid continuously without severance.

In the first-type application method and the second-type application method, it is preferable that the distance over which the coating liquid supplied from the coating liquid supplying means falls down to the bead is not more than 80 mm.

In the first-type application method and the second-type application method, it is preferable that the web is drawn and dried after the coating liquid is applied over its surface to form a coating film. Such drawing and drying may be carried out by performing drawing first followed by drying, by performing drying first followed by drawing, or by performing drawing and drying simultaneously.

A method for manufacturing a web of the invention to meet the objects is as follows:

A method for manufacturing a web having a coating film on a surface thereof, comprising extruding a polymer from an extruder into a sheet to provide a web, and applying a coating liquid over the web with the first-type application method or the second-type application method to produce a coating film on a surface of the web.

Effect of the Invention

The use of the application apparatus and application method of the invention serves to prevent such coating defects as described previously that can result from a conventional coating liquid supply method. It also serves to decrease the unevenness in the thickness of the coating film.

If the position of the coating liquid supplying means can be adjusted independently of the position of the application bar, it will be possible to supply the coating liquid accurately to a desired position of the bead regardless of the electrostatic conditions of the web. This also allows the process to be carried out for different sizes of bead, and various products of different widths can be produced. Furthermore, the operations for termination of the application process to be performed quickly. If the application bar is removed after removing the coating liquid supplying means from the web, for example, coating liquid falling from the coating liquid supplying means, if any, would be smoothed by the application bar, making it possible, for example, to prevent contamination of the apparatus from being caused by insufficient drying of the coating film during the subsequent drying process.

EXPLANATION OF SYMBOLS

Figure 1:
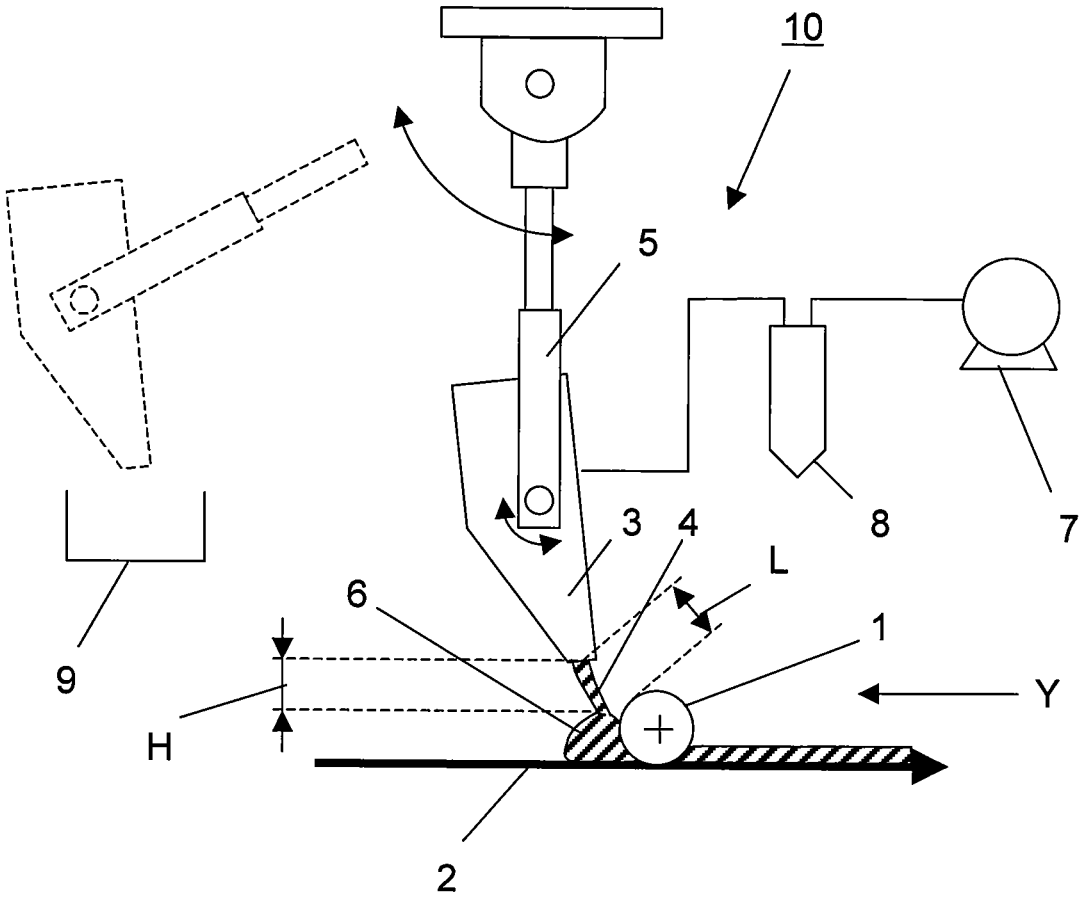
FIG. 1 is a schematic side view of an embodiment of the application apparatus of the invention.

1 application bar (metering bar)
2 web
3 coating liquid supplying means (die)
4 coating liquid
5 moving mechanism
6 bead
7 pump
8 filter
9 liquid receiver
10 application apparatus comprising coating liquid supplying means without smooth portion
11 application apparatus comprising coating liquid supplying means with smooth portion
20 smooth portion

BEST MODE FOR CARRYING OUT THE INVENTION

The present invention is further explained below with examples and drawings.

In FIG. 1, an application apparatus 10 of the invention comprises an application bar 1, a web conveying apparatus (not shown) that allows a web 2 to run under the application bar 1, and a coating liquid supplying means (die) 3 that serves to supply a coating liquid directly to a bead 6 that is formed in contact with the running web 2 and the application bar 1 on the upstream side of the application bar 1.

In the application apparatus 10, a coating liquid 4 is supplied directly to the bead 6 from the die 3 which serves as the coating liquid supplying means. With the assistance of a moving mechanism 5, the die 3 can move between a position of supplying the coating liquid, which is indicated by a solid line, and a position of retreat, which is indicated by a broken line. The bead 6 is formed immediately upstream from the contact portion between the application bar 1 and the web 2, and the coating liquid 4 discharged from the die 3 is supplied directly to the bead 6 before coming in contact with the application bar 1 or the web 2. The coating liquid 4 is supplied into the die 3 from an appropriate coating liquid tank (not shown) through a pump 7 and a filter 8, wherein the pump 7 and the filter 8 are components of one exemplary embodiment of an apparatus for continuously supplying the coating liquid to the die 3. A liquid receiver 9 is provided at the retreat position of the die 3. The liquid receiver 9 receives coating liquid spilling from the die 3.

Figure 14:
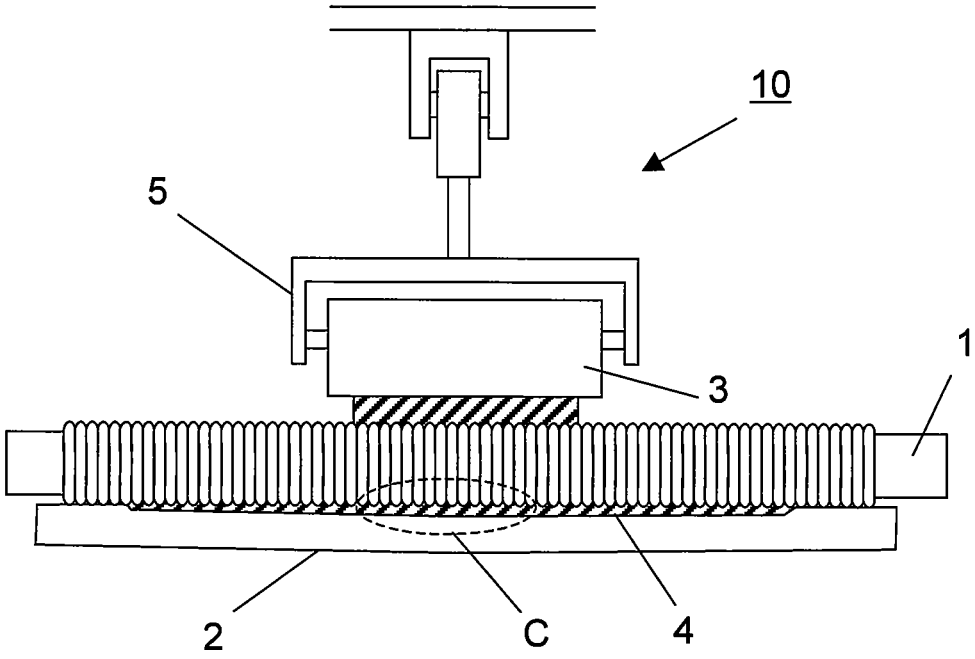
FIG. 14 is a schematic front view of the application apparatus of the invention shown in FIG. 1, looked from the direction indicated by the arrow Y in FIG. 1.
Figure 15:
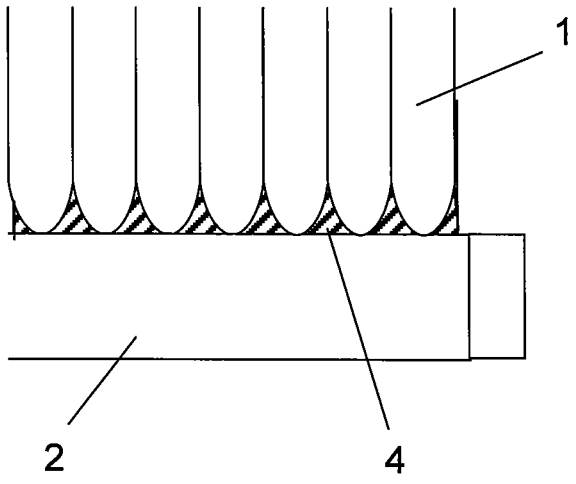
FIG. 15 is an enlarged schematic front view that describes the relation among the application bar, coating liquid and web in an embodiment.
Figure 16:
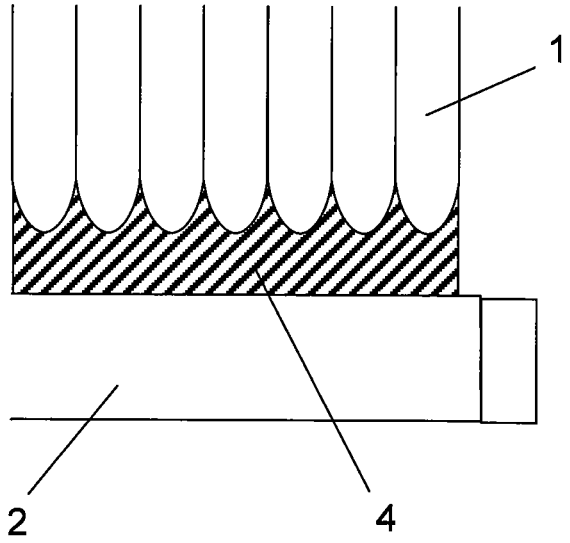
FIG. 16 is an enlarged schematic front view that describes the relation among the application bar, coating liquid and web in another embodiment.
Figure 17:
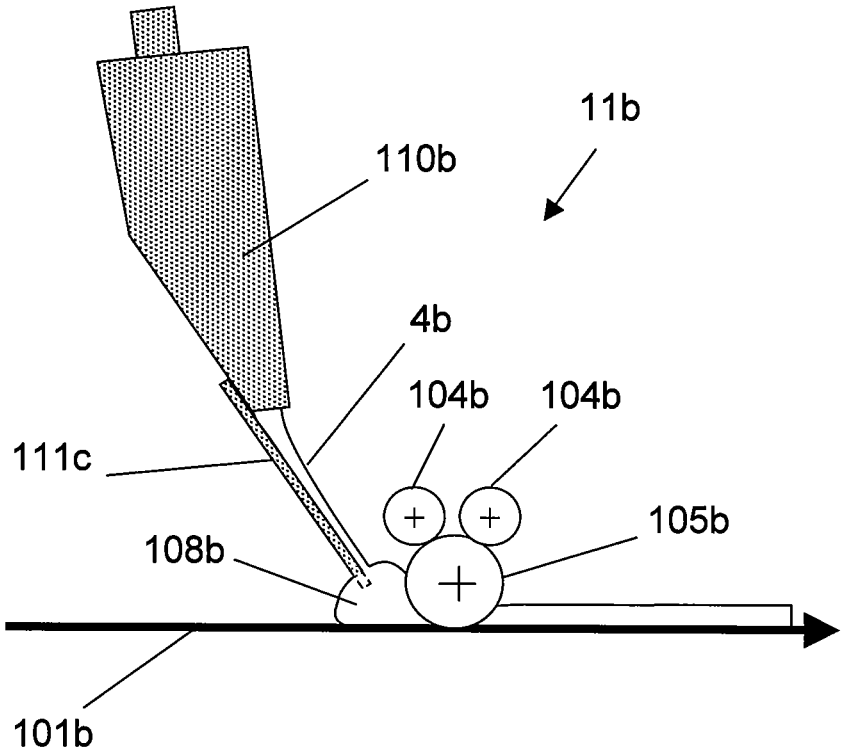
FIG. 17 is a schematic side view that described tip of the smooth portion of the coating liquid supplying means in the application apparatus of the invention shown in FIG. 11, which is inserted in the bead.

FIG. 14 gives a schematic front view of the application apparatus 10 of the invention shown in FIG. 1, looked from the direction of the arrow Y in FIG. 1. FIGS. 15 and 16 are enlarged front views of the portion C which is indicated by a broken line in FIG. 14. The application bar may be a rod, a wire bar (comprising a rod wound with a wire), or a grooved bar (produced by grooving a rod). The application bar 1 shown in FIG. 14 is a wire bar. As illustrated in FIG. 14, the application bar 1 comprises a rod wound with a wire to form grooves. This application bar 1 is allowed to coming contact with the web 2 so that coating liquid is applied over the upper surface of the web 2. The coating liquid exists at the contact portion between the application bar 1 and the web 2 as illustrated in FIGS. 15 and 16, and an amount of application liquid that corresponds to size of a gap between the application bar 1 and the web 2 (grooves on a surface of the application bar and the gap between the application bar and the web) is applied over the web 2.

Figure 2:
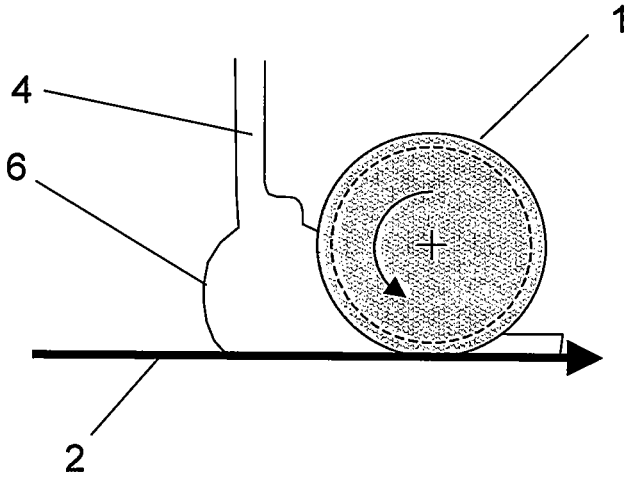
FIG. 2 is an enlarged side view near the bead in the apparatus is shown in FIG. 1.

FIG. 2 gives a side view of an example where the application bar 1 rotates in the same direction as the running of the web 2. As described previously, feeding streaks are less likely to occur because the coating liquid 4 discharged from the die 3 is supplied directly to the bead 6. The direct supply of coating liquid to the bead 6 also serves to prevent air from being taken in, eliminating the possibility of bubble streaks resulting from such air taken in.

The coating liquid supplying means to be used for the invention may be a die, nozzle, or spray that can discharge the coating liquid continuously at a constant rate. The supply of the coating liquid to the bead 6 may be carried out by supplying the coating liquid directly to the face of the bead, or by inserting the outlet of the nozzle, die, etc., into the bead to permit direct feeding to the inside of the pool.

If the discharge rate of the pump fluctuates, the size of the bead fluctuates to cause variation in the coating width.

The pump 7, therefore, should preferably be a gear pump, Mono pump, diaphragm pump, etc., that can feed the coating liquid at a constant rate. To ensure stability of the bead, the pump should preferably have a ripple factor in the range of −3.5% to +3.5%. Here the ripple factor is defined as follows:

Ripple factor=[(maximum instantaneous discharge−minimum instantaneous discharge)/average discharge]×(100/2)

The ripple factor is measured with a mass flowmeter (for example, Model 63FS08-NEW00A30B1A manufactured by Endress Hauser Japan Co., Ltd.) at a measuring period of 0.15 sec.

Figure 3:
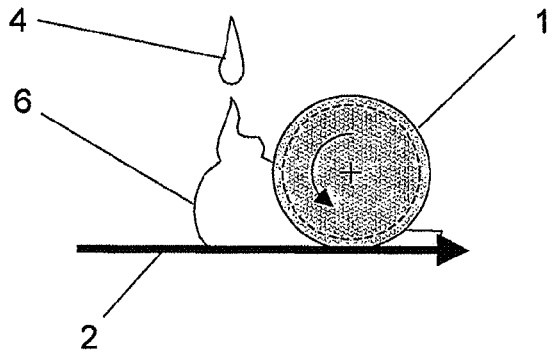
FIG. 3 is an explanatory view where a drop of a coating liquid happens in the apparatus shown in FIG. 2.

If the coating liquid 4 is supplied to the bead 6 disconnectedly in drops in the application apparatus 10 as shown, for example, in FIG. 3, such discontinuous addition can cause fluctuations in the liquid pressure in the bead 6 to produce coating defects. The coating liquid, therefore, should preferably be supplied to the bead 6 continuously without severance.

Figure 4:
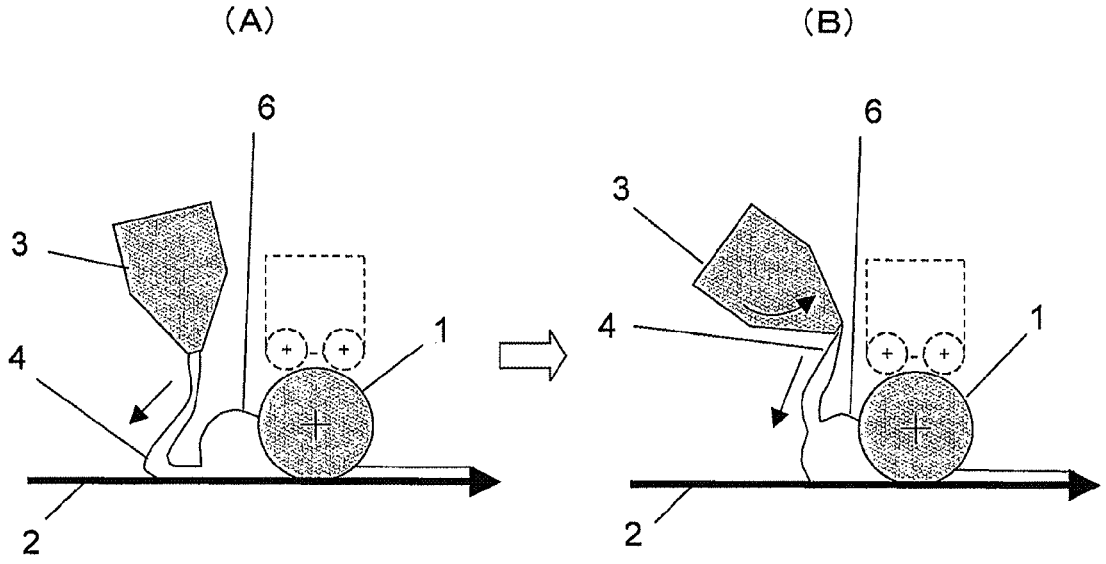
FIG. 4 is an explanatory view that explains the effectiveness of the position-adjustable coating liquid supplying means. FIG. (A) in the left of FIG. 4 is a schematic side view of a coating liquid supplying means at its initial position, and FIG. (B) in the right of FIG. 4 is a schematic side view of the coating liquid supplying means after moving from the position illustrated in FIG. (A).

If the running web 2 is charged with static electricity, the coating liquid 4 will be pulled by the static electricity as it is discharged from the die 3 as illustrated, for example, in the diagram (A) in the left of FIG. 4, and as a result it can come in contact with the web 2 before being supplied to the bead 6. If influence of such static electricity exists, a position of the die 3 should preferably be adjusted to ensure direct supply of the coating liquid to the bead 6.

In the application apparatus 10 shown in FIG. 1, this position adjustment is carried out by a moving mechanism 5. If the position of the die 3 relative to the application bar 1 or the web 2, particularly the position of the die 3 relative to the bead 6, is adjusted properly, it will be possible for the coating liquid 4 to be supplied directly to the bead 6 even in a state where influence of static electricity exists as illustrated in the diagram (B) in the right of FIG. 4.

Figure 5:
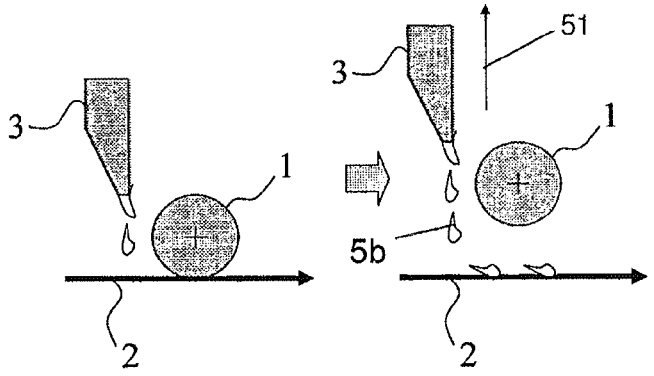
FIG. 5 is a schematic side view that describes an undesirable state resulting from a die and an application bar that cannot move independently of each other.

In the application apparatus 10, the die 3, which serves as the coating liquid supplying means, and the application bar 1 should be able to move independently of each other. If the die 3 and application bar 1 cannot move independently of each other, the die 3 and the application bar 1 will rise together at the completion of the coating process as shown, for example, by the arrow 51 in FIG. 5, allowing liquid droplets **5*b* to fall from the die 3 to produce thick layers of the coating liquid on the web 2. Such thick layers of the coating liquid will fail to dry completely during the subsequent drying process, possibly leading to contamination of the apparatus following the drying process. After the completion of the coating process, therefore, the operator has to wait until the coating liquid has stopped falling, before moving the die 3 and the application bar 1**.

Figure 6:
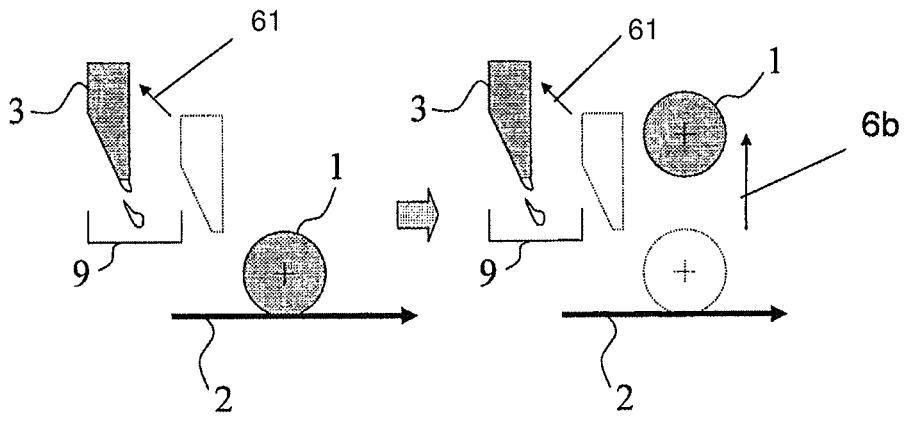
FIG. 6 is a schematic side view that describes prevention of undesirable states to be achieved by a die and an application bar that can move independently of each other.
Figure 7:
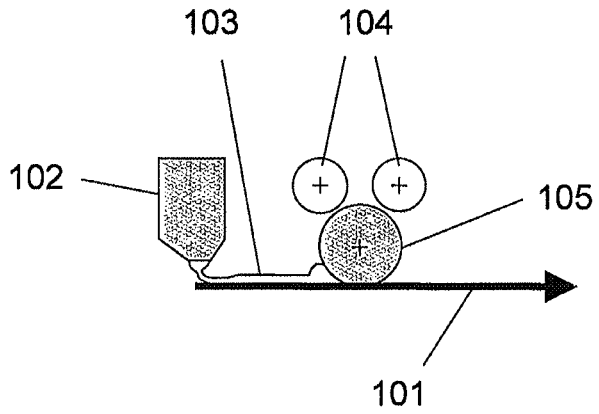
Fig. 7 PRIOR ART
FIG. 7 is a schematic side view of a conventional application apparatus comprising a common metering bar.
Figure 8:
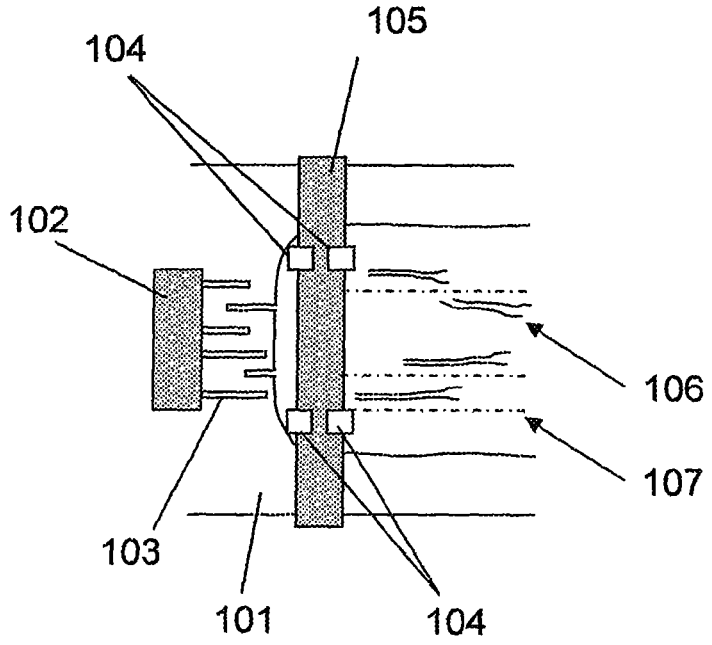
Fig. 8 Prior Art
FIG. 8 is a schematic plan view that describes coating defects taking place in the apparatus shown in FIG. 7.

If the die 3 and the application bar 1 can move independently of each other, however, as shown, for example, in FIG. 6, the die 3 can be moved and retreated first as indicated by the arrow 61 to allow the liquid receiver 9 to receive the coating liquid falling in droplets from the die 3 to prevent its falling onto the web 2. The application bar 1 can be retreated subsequently as indicated by the arrow **6*b*** to prevent the defects from taking place during the operation to finish the coating process. Thus the coating process can be finished quickly.

The application apparatus and the application method of the invention may be used in in-line of a process for producing a web, or may be used to a web in a separated web production process, that is, in off-line of a process for producing a web.

Figure 18:
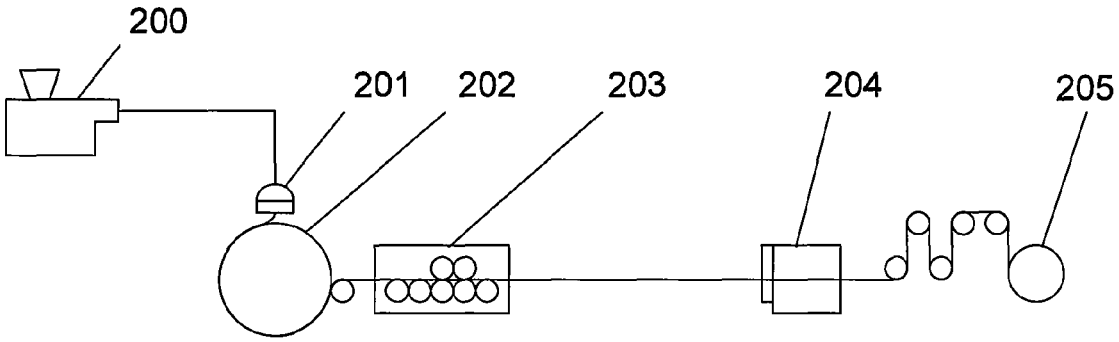
FIG. 18 is a schematic process chart that describes an example of the web production process.

The configuration of an apparatus that incorporates a coating step in a web production process is described below with reference to FIGS. 18 and 19. FIG. 18 shows a typical web production process, and FIG. 19 illustrates a web production process as shown in FIG. 18 that incorporates a coating step.

The web production process shown in FIG. 18 comprises an extruder 200, a nozzle 201, a casting drum 202, a longitudinal drawing machine 203, a transverse drawing machine 204, and a winder roll 205. First, a polymer is extruded from the extruder 200, and then the polymer is processed into a web (sheet) as it goes through the nozzle 201 and casting drum 202. The resulting web is then subjected to the longitudinal drawing machine 203 and the transverse drawing machine 204 to carry out longitudinal and transverse drawing, and the drawn web is wound up continuously by the winder roll 205.

Figure 19:
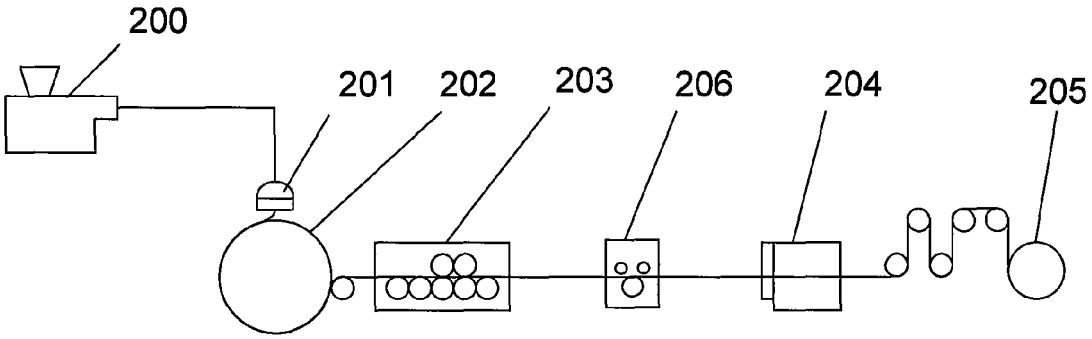
FIG. 19 is a schematic process chart that describes an example of the web production process with a coating liquid application step provided in the web production process shown in FIG. 18.

When a coating step is carried out in the web production process, an application apparatus 206, for example, may be provided between the longitudinal drawing machine 203 and transverse drawing machine 204 as illustrated in FIG. 19 so that longitudinally drawn web is subjected to the coating step. A stepwise biaxial drawing machine that performs longitudinal drawing before transverse drawing is shown here, but the application apparatus may be provided before a simultaneous biaxial drawing machine.

Figure 11:
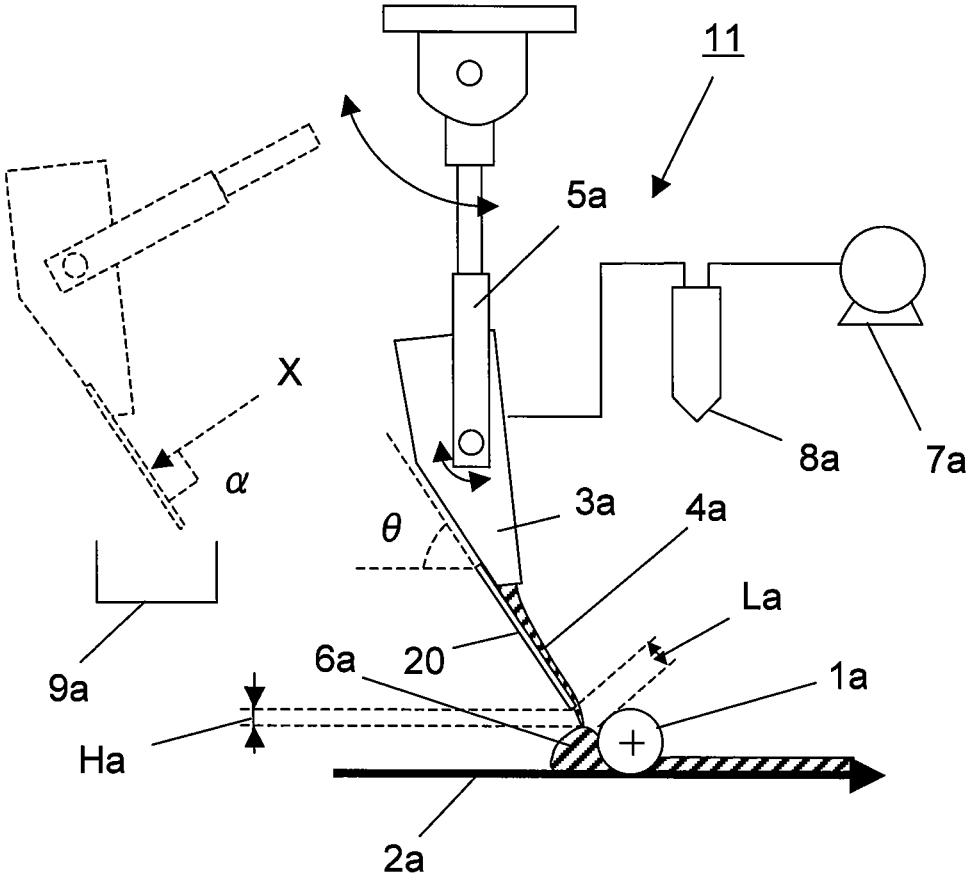
FIG. 11 is a schematic side view of another embodiment of the application apparatus of the invention.

FIG. 11 illustrates an application apparatus 11, another embodiment of the application apparatus of the invention. In the application apparatus 11 shown in FIG. 11, a die 3*a*, which serves as coating liquid supplying means, has a smooth portion 20, and the other components are the same as in the application apparatus 10 shown in FIG. 1, that is, a moving mechanism 5*a*, a rump 7*a*, a filter 8*a*, and a liquid receiver 9*a* correspond generally to the moving mechanism 5, the pump 7, the filter 9, and the liquid receiver 9 in FIG. 1 respectively.

By supplying the coating liquid to the bead through the smooth portion, the unevenness that is produced in the width direction during the discharge from the die or nozzle is eliminated under the effect of gravity as the coating liquid flows on the smooth portion. Thus, the smooth portion serves to achieve more uniform supply of the coating liquid, producing a web having a decreased unevenness in the coating thickness.

The application apparatus that comprises a smooth portion is similar to the apparatus with a slide coater proposed in Non-patent reference 1. In the application apparatus of the invention, however, the coating liquid is supplied to the bead, and the coating liquid supplied to the bead stays there for a while as part of the bead, followed by being pulled out at a constant rate by the application bar to produce a coating layer on the web. Thus, the thickness of the coating layer formed on the web is not influenced by the coating liquid supply rate. With the slide coater, on the other hand, the coating liquid supplied is directly fed onto the web, and so the thickness of the coating layer formed on the web is influenced by the coating liquid supply rate. At least in this regard, these two coating mechanisms are completely different from each other. Furthermore, the smooth portion in the application apparatus of the invention is intended to smooth the flow of the coating liquid, and so its purpose and effect are different from those of the slide coater which is intended to produce a multi-layer structure.

For supply of the coating liquid in the application apparatus shown in FIG. 11, the coating liquid from the coating liquid supplying means (die 3 and smooth portion 20) should preferably be fed to the bead 6 directly and continuously without severance before coming in contact with the application bar 1 or the web 2 as in the case of the application apparatus shown in FIG. 1. In performing this, the liquid may be supplied onto the face of the bead, or the tip of the smooth portion may be inserted into the bead to feed the liquid directly into the inside of the bead. If the tip of the smooth portion is inserted too deeply, however, the bead will be disturbed to cause coating defects, and so the insertion depth of the smooth portion should preferably be not more than 2 mm as measured from the face of the bead.

For the adjustment of the width of the coating film applied over the web, a camera etc. should preferably be used to monitor the position at the end of the coating film immediately after application to allow the coating width to be adjusted based on results of the monitoring so that the width will not become too large. Such adjustment may be performed by controlling the coating liquid discharge rate of the pump, the web conveyance speed, the tension of the web, the viscosity of the coating liquid, the rotation speed of the application bar, or the extrusion rate of the application bar. In case such adjustment cannot be performed quickly enough as the coating width increases rapidly, it is preferred to use equipment that ensures emergency stop of the web coating and conveyance operations in response to signals sent from the monitoring camera.

Examples and their results are described below, where the application apparatus and the application method of the invention are used to apply a coating liquid over the upper surface of a sheet (web) of polyethylene terephthalate (PET). Hereafter, feeding streaks, unevenness in thickness, and bubble streaks refer to those detected by visual observation of the face of the film obtained after drying the coating layer that is produced by applying the coating liquid over the face of the sheet.

Example 1

A sheet of PET resin extruded from a die onto a casting drum was drawn up to 300% in the longitudinal direction to produce a uniaxially drawn film, which was then allowed to travel at a speed of 25 m/min while the application apparatus 10 of the invention shown in FIG. 1 was used to apply a coating liquid over the upper face of the sheet.

Coating Conditions Used are as follows:

(a) coating liquid supplying means: coracoid die (slit width 90 mm, gap 0.1 mm, land length 30 mm)

(b) distance over which coating liquid falls down to bead: 40 mm (c) traveling speed: 25 m/min (d) coating liquid viscosity: 1.5 Pa·s (e) coating width (W): 250 mm (f) discharge rate: 100 ml/min (g) application bar: wire bar (diameter 19 mm, length 300 mm, wire diameter 0.356 mm)

(h) pump: diaphragm pump manufactured by Tacmina Corporation (ripple factor in the range of ±3.5%)

Figure 20:
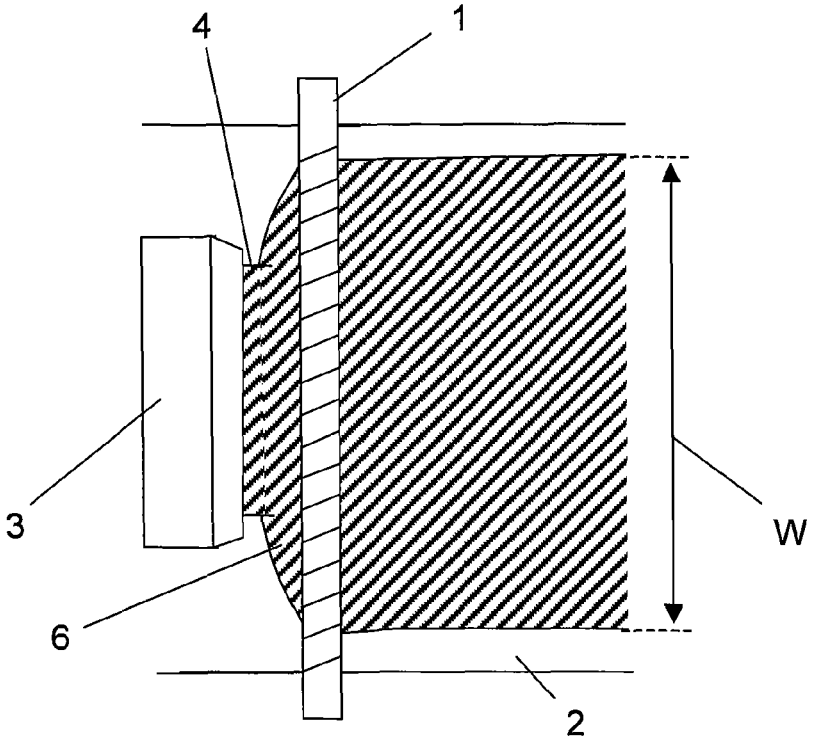
FIG. 20 is a schematic plan view that described the coating liquid applied in the width direction of the web during the web production in the application apparatus of the invention shown in FIG. 1.

The coating width (W) is as shown in FIG. 20 (moving mechanism not shown) which is a plan view of the application apparatus 10 shown in FIG. 1.

A coating liquid in a sheet-like shape was supplied directly to the bead that formed at the contact portion between the wire bar and the PET film to perform coating. Visual observation detected no feeding streaks or bubble streaks on the dried coat surface. However, a slightly uneven thickness distribution was found in the width direction of the film.

Comparative Example 1

Figure 10:
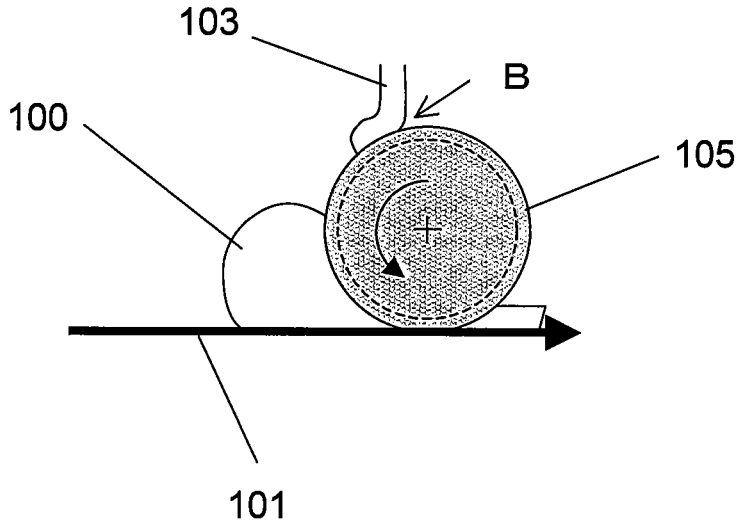
FIG. 10 is a schematic side view that describes inclusion of air taking place in another conventional apparatus.

Coating was carried out by the same procedure as in Example 1 except that the coating liquid was supplied to a higher position of the wire bar as shown in FIG. 10. Visual observation detected feeding streaks and a slightly uneven thickness distribution on the dried coat surface. Furthermore, 4 to 8 bubble streaks were always formed over the entire coating width, and visual observation detected some marks left by these bubble streaks in dried products. Thus, the coated sheet failed to meet product quality requirements and it was evaluated as defective.

Comparative Example 2

Figure 9:
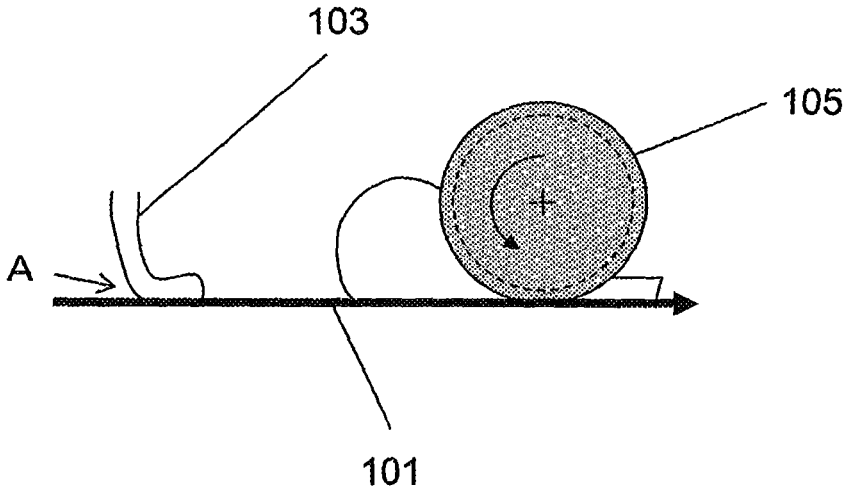
Fig. 9 Prior Art
FIG. 9 is a schematic side view that describes inclusion of air taking place in a conventional apparatus.

Coating was carried out by the same procedure as in Example 1 except that the coating liquid was supplied from above the sheet surface to a position upstream from the application bar as shown in FIG. 9. Visual observation detected feeding streaks and an uneven thickness distribution on the dried coat surface. Furthermore, 2 to 5 bubble streaks were always formed over the entire coating width, and visual observation detected some marks left by these bubble streaks in dried products. Thus, the coated sheet failed to meet product quality requirements and it was evaluated as defective.

Example 2

Coating was carried out by the same procedure as in Example 1 except that the distance over which the coating liquid falls down from the coating liquid supplying means to the bead was 90 mm. On the dried coat surface, visual observation detected slight feeding streaks and an uneven thickness distribution that seemed to have been formed during the supply of the coating liquid. These slight feeding streaks and an uneven thickness distribution were not caused when the distance was not more than 80 mm.

Example 3

Coating was carried out by the same procedure as in Example 1 except that the coating liquid from the die was supplied discontinuously in droplets on purpose as illustrated in FIG. 3. Visual observation detected feeding streaks formed on the dried coat surface at positions where droplets existed. An uneven thickness distribution was also detected though it was very small.

Example 4

Figure 13A:
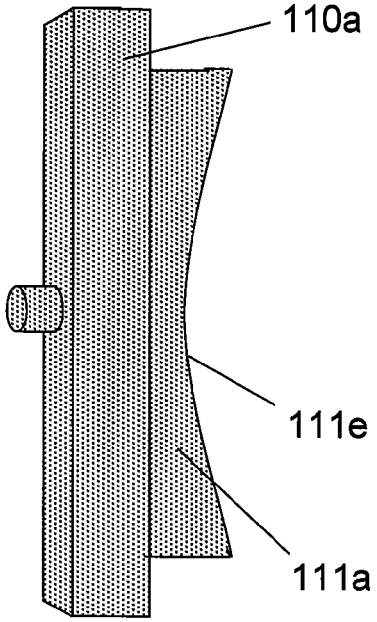
FIG. 13A is a schematic plan view of a coating liquid supplying means in another application apparatus as shown in FIG. 11.
Figure 13B:
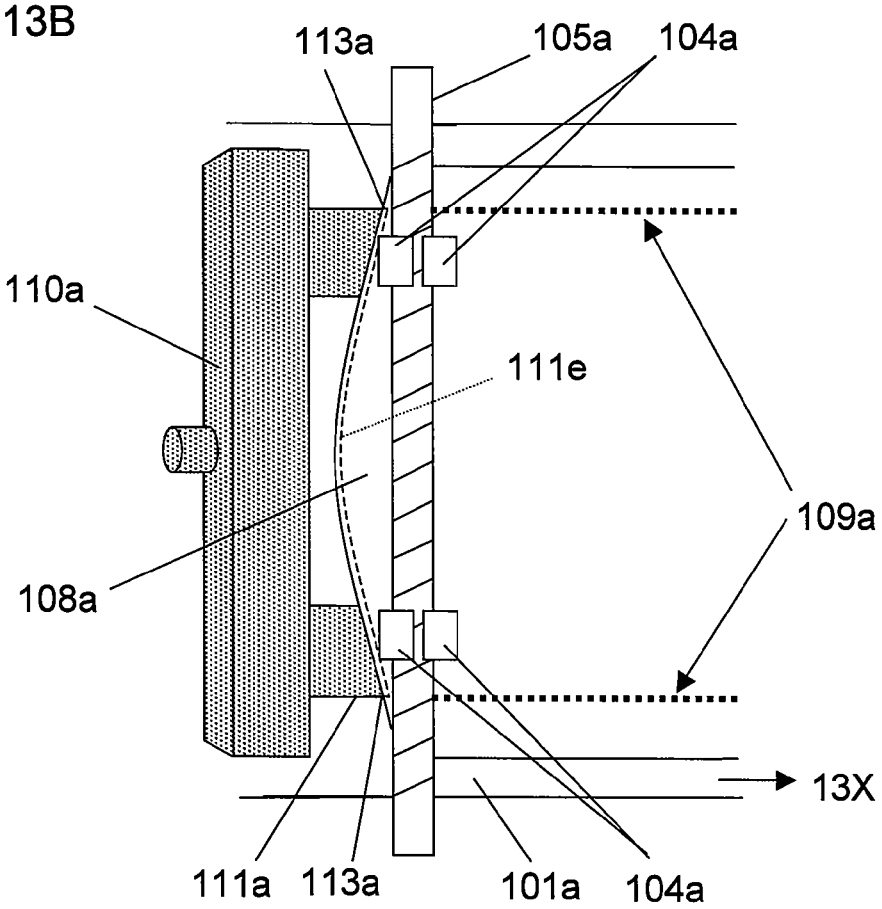
FIG. 13B is a schematic plan view that describes the relation between the coating liquid supplying means and the bead shown in FIG. 13A.

Coating was carried out by the same procedure as in Example 1 except that the application apparatus 11 of the invention shown in FIG. 11 was used and that the arc-like edge 111*e* of the smooth portion 111*a* was inserted into the bead as shown in FIGS. 13A and 13B. The conditions of the smooth portion used were as follows:

(a) distance over which coating liquid flows with its upper face open to the air: 30 mm (b) inclination angle θ: 30°

(c) edge shape: arc-like shape that fits the bead

Visual observation detected two streaks 109*a* on the dried coat surface as shown in FIG. 13B. Each of the streaks 109*a* was found at a position 105 mm away from the center of the coat surface. Nevertheless, feeding streaks, bubble streaks, or uneven thickness distributions were not detected. Thus, a product having a width of 210 mm (distance between the two streaks 109*a*) was obtained from the sheet produced by the coating process.

Example 5

Figure 12A:
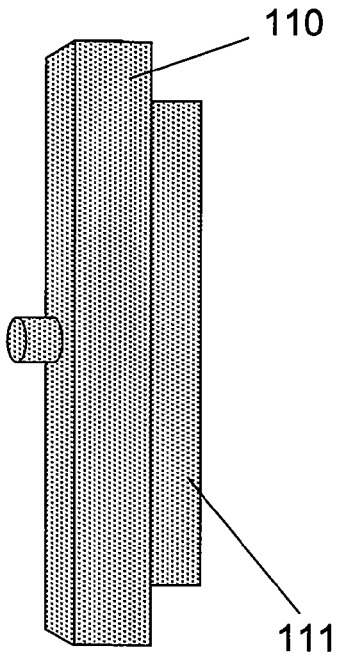
FIG. 12A is a schematic plan view of a coating liquid supplying means of in the application apparatus shown in FIG. 11.
Figure 12B:
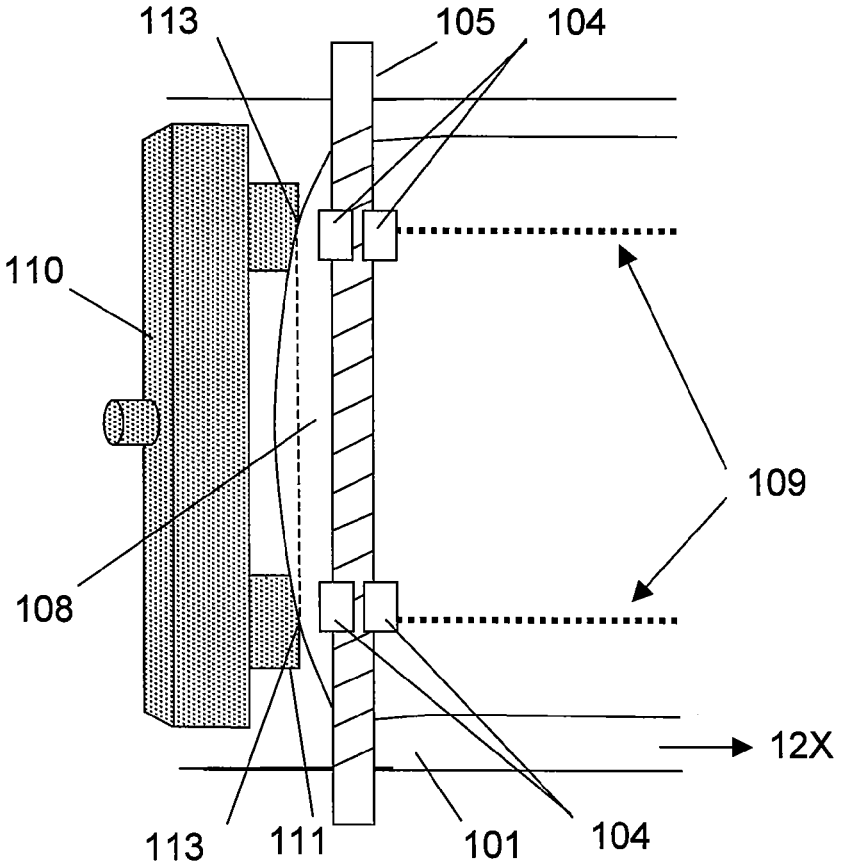
FIG. 12B is a schematic plan view that describes the relation between the coating liquid supplying means and the bead shown in FIG. 12A.

Coating was carried out by the same procedure as in Example 4 except that the smooth portion 111 with a flat edge shown FIGS. 12A and 12B were used in the application apparatus 11 of the invention shown in FIG. 11 and that the edge of the smooth portion 111 was inserted into the bead. Visual observation detected no feeding streaks, bubble streaks, or uneven thickness distributions on the dried coat surface. Nevertheless, visual observation detected streaks 109 on the dried coat surface at the right- and left-side positions 80 mm away from the center in the width direction. The width of the resulting product was 160 mm. This product width of 160 mm is smaller than the 210 mm width of the product produced in Example 4. This shows that the edge of the smooth portion should have an arc-like shape that fits the bead if a product having a larger width is to be produced.

Example 6

Coating was carried out by the same procedure as in Example 2 except that the equipment used was the application apparatus 11 of the invention shown in FIG. 11 in which the arc-like edge 111*b* of the smooth portion 111*a* shown in FIGS. 13A and 13B had an inclination angle θ of 70° and the distance over which the coating liquid flows with its upper face open to the outside was 5 mm. Visual observation detected no feeding streaks or bubble streaks on the dried coat surface. However, an uneven thickness distribution was detected though it was very small. This small uneven thickness distribution can be eliminated by properly adjusting the inclination angle θ of the smooth portion and the distance over which the coating liquid flows with its upper face open to the air.

INDUSTRIAL APPLICABILITY

The application apparatus and the application method of the invention are characterized in that the coating liquid is supplied to the upper face of the web after flowing down on a smooth portion with its upper face open to the outside, or that the coating liquid is supplied directly to a bead of the coating liquid. This feature makes it possible to produce a product that has a coating film having a high-quality surface free of feeding streaks that result from improper supply of the coating liquid or bubble streaks that contain air. If the edge of the smooth portion has a properly selected shape, it will be possible to maximize the distance in the width direction between the streaks that form in the longitudinal direction of the web at both ends, allowing a product having a wide coating film to be produced. Furthermore, the step of applying a high-viscosity coating liquid over a web can be incorporated in a web (sheet or film) production process.

The invention claimed is:

1. An application apparatus for applying a coating liquid on an upper surface of a running web, the application apparatus comprising:

an application bar positioned to form a bead of the coating liquid at a bead forming area existing in the upstream neighborhood of a contact portion between the application bar and the web, the center portion of the bead having a bulge that becomes smaller at end portions of the bead, a coating liquid supply provided to supply the coating liquid to the upper surface of the web at a position upstream from a position of the application bar, wherein the coating liquid supply has a smooth portion on which the coating liquid flows down in a state that an upper side of the coating liquid is open to the outside, wherein the coating liquid supply is provided at a position that allows the coating liquid to be supplied directly to the bead forming area existing in the upstream neighborhood of the contact portion between the application bar and the web, wherein an edge of the smooth portion that is faced toward the application bar has an arc-like recessed shape having both end portions thereof being extended farther downward than the center portion thereof in the width direction of the web, wherein the edge of the smooth portion is positioned to be inserted into the bead forming at the bead forming area over nearly an entire width of the edge, and wherein the edge of the smooth portion having the arc-like recessed shape, when inserted into the bead, is configured to shift the position of streaks in the coating liquid toward an end of a coated portion of the running web, thus widening the coated portion of the web that can be used.

2. The application apparatus according to claim 1, wherein an inclination angle of the smooth portion to a horizontal direction is in the range of 10 to 60° and a distance along which the coating liquid flows down in the state is in the range of 10 to 200 mm.

3. The application apparatus according to claim 1, wherein the coating liquid supply includes an apparatus for continuously supplying the coating liquid.

4. The application apparatus according to claim 1, wherein the coating liquid supply includes means for adjusting a distance over which the coating liquid supplied from the coating liquid supply falls down to the bead at not more than 80 mm.

5. The application apparatus according to claim 1, wherein a moving means that allows the coating liquid supply to move independently of the application bar is provided.

6. The application apparatus according to claim 5, wherein the moving means allows the coating liquid supply to move over a distance of 0.1 to 500 mm from the application bar during the application of the coating liquid.

7. The application apparatus according to claim 1, wherein a liquid receiver that can receive the coating liquid spilling from the coating liquid supply.

* * * * *